US011164492B2

(12) United States Patent
Mei

(10) Patent No.: US 11,164,492 B2
(45) Date of Patent: Nov. 2, 2021

(54) APPARATUS FOR PICTURE TEST OF DISPLAY PANEL AND TEST METHOD FOR PICTURE OF DISPLAY PANEL

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventor: Wenlin Mei, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 547 days.

(21) Appl. No.: 16/092,476

(22) PCT Filed: Mar. 30, 2018

(86) PCT No.: PCT/CN2018/081226
§ 371 (c)(1),
(2) Date: Oct. 10, 2018

(87) PCT Pub. No.: WO2018/210068
PCT Pub. Date: Nov. 22, 2018

(65) Prior Publication Data

US 2021/0217335 A1 Jul. 15, 2021

(30) Foreign Application Priority Data

May 19, 2017 (CN) ..... 201710358806.1

(51) Int. Cl.
*G09G 3/00* (2006.01)
*G09G 3/20* (2006.01)

(52) U.S. Cl.
CPC ..... *G09G 3/006* (2013.01); *G09G 3/2092* (2013.01); *G09G 2310/0278* (2013.01)

(58) Field of Classification Search
CPC ..... G06T 13/40; G06T 1/60; G06T 2213/12; G06T 1/20; G06F 3/017; G06F 3/011; G06F 3/041
See application file for complete search history.

(56) References Cited

U.S. PATENT DOCUMENTS

2013/0088679 A1 4/2013 Lu
2014/0184967 A1 7/2014 Xu et al.
(Continued)

FOREIGN PATENT DOCUMENTS

CN 102110400 A 6/2011
CN 103033955 A 4/2013
(Continued)

OTHER PUBLICATIONS

Search Report and Written Opinion for International Application No. PCT/CN2018/081226 dated Jun. 29, 2018.
(Continued)

*Primary Examiner* — Mark W Regn
(74) *Attorney, Agent, or Firm* — Calfee, Halter & Griswold LLP

(57) ABSTRACT

Disclosed are an apparatus for picture test of a display panel and a test method for a picture of a display panel. The apparatus includes: a first scanning unit, a second scanning unit, a data signal source and a controller. The display panel includes pixel units, and for the same column of pixel units, the odd numbered rows of pixel units and the even numbered rows of pixel units are connected with different data lines, respectively, and the individual pixel units of the same row are connected with the same grid line, respectively. The first scanning unit may be configured for receiving and trans-
(Continued)

mitting a first scanning signal for scanning odd numbered rows of grid lines, and the second scanning unit may be configured for receiving and transmitting a second scanning signal for scanning even numbered rows of grid lines.

8 Claims, 4 Drawing Sheets

(56) References Cited

U.S. PATENT DOCUMENTS

| | | | | |
|---|---|---|---|---|
| 2015/0325158 | A1 | 11/2015 | Shao et al. | |
| 2016/0042677 | A1* | 2/2016 | Lee | G02F 1/1345 324/760.01 |
| 2016/0210916 | A1* | 7/2016 | Jeong | G09G 3/3648 |
| 2016/0240117 | A1* | 8/2016 | Xu | G09G 3/3225 |
| 2018/0075791 | A1 | 3/2018 | Li | |

FOREIGN PATENT DOCUMENTS

| | | | |
|---|---|---|---|
| CN | 103217844 | A | 7/2013 |
| CN | 104795044 | A | 7/2015 |
| CN | 105590572 | A | 5/2016 |
| CN | 106297615 | A | 1/2017 |
| CN | 106409252 | A | 2/2017 |
| CN | 106935167 | A | 7/2017 |
| JP | 2007183527 | A | 7/2007 |

OTHER PUBLICATIONS

First Office Action for Chinese Patent Application No. 201710358806.1 dated Mar. 4, 2019.

* cited by examiner

APPARATUS FOR PICTURE TEST OF DISPLAY PANEL AND TEST METHOD FOR PICTURE OF DISPLAY PANEL

RELATED APPLICATIONS

The present application is the U.S. national phase entry of PCT/CN2018/081226, with an international filing date of Mar. 30, 2018, which claims the benefit of Chinese Patent Application No. 201710358806.1 filed on May 19, 2017, the entire disclosures of which are incorporated herein by reference.

TECHNICAL FIELD

The disclosure relates to, but not limited to the display technology, and in particular, to an apparatus for picture test of a display panel and a test method for a picture of a display panel.

BACKGROUND

Nowadays, the grid array (first scanning signal A) technique is widely applied in panel development, which may not only narrow the frame, but also reduce the cost. The cell test modes of notebooks (NB) and mobile phones (mobile) mostly employ the data signal switch (data switch) mode, which has the advantage of saving capacity. However, due to the limitation by laser cutting, many products cannot be designed to be in a (one-to-one correspondence) contact mode.

The data signal switch drives thousands of data signal lines through data lines of the multiple of 3 (three, six). Taking the full high definition (FHD) as an example, 3 data lines need drive 5,761 data signal lines, resulting in that the delay of each data signal line is large, wherein the delay measured in practice is up to above 100 us, whereas the actual data pulse width of the FHD is 14.8 us. In all the Z inversion designs, in a case of a picture of red (R), green (G) and blue (B), since the delay is large, the data line (Data) cannot give a correct data signal, which results in abnormal display of the RGB picture.

If the cell test cannot normally display a RGB picture, it cannot detect the short of adjacent data lines and the short between pixels.

SUMMARY

The following is a summary of the subject described in detail in this context. The summary is not intended to limit the protective scope of the claims.

The disclosure provides an apparatus for picture test of a display panel and a test method for a picture of a display panel.

According to an embodiment of the disclosure, there is provided an apparatus for picture test of a display panel including a first scanning unit, a second scanning unit, a data signal source and a controller. The display panel includes pixel units defined by cross of data lines and grid lines. For the same column of pixel units, odd numbered rows of pixel units are connected with the same data line, even numbered rows of pixel units are connected with the same data line, and the odd numbered rows of pixel units and the even numbered rows of pixel units are connected with different data lines, respectively. The individual pixel units of the same row are connected with the same grid line, respectively. The first scanning unit may be configured for receiving and transmitting a first scanning signal for scanning odd numbered rows of grid lines. The second scanning unit may be configured for receiving and transmitting a second scanning signal for scanning even numbered rows of grid lines. The data signal source is connected with data lines in the display panel, and may be configured for outputting a data signal to a pixel unit in the display panel. The controller may be configured for controlling the first scanning unit, the second scanning unit and the data signal source to perform preset color picture test on the display panel.

In an embodiment, there is a preset time interval between the first scanning signal and the second scanning signal.

In an embodiment, two adjacent columns of pixel units in the display panel di splay different colors.

In an embodiment, each of the data lines is arranged between two adjacent columns of pixel units, and connected with the odd numbered rows of pixel units of one column of the two adjacent columns of pixel units and the even numbered rows of pixel units of the other column.

In an embodiment, the data line includes a first data line, a second data line and a third data line, the first data line, the second data line and the third data line are repetitively arranged in sequence along the row direction, and the data signal source includes a first data signal source, a second data signal source and a third data signal source.

In an embodiment, the data signal source further includes a first switch tube, a second switch tube and a third switch tube, and the control terminals of the first switch tube, the second switch tube and the third switch tube are connected with the controller. Therein, a first terminal of the first switch tube is connected with the first data line, and a second terminal thereof is connected with the first data signal source, a first terminal of the second switch tube is connected with the second data line, and a second terminal thereof is connected with the second data signal source, and a first terminal of the third switch tube is connected with the third data line, and a second terminal thereof is connected with the third data signal source.

In an embodiment, the first scanning unit includes first field effect tubes arranged in one-to-one correspondence with individual odd numbered rows of grid lines, and the second scanning unit includes second field effect tubes arranged in one-to-one correspondence with individual even numbered rows of grid lines.

In an embodiment, both the first field effect tubes and the second field effect tubes are N-channel field effect tubes.

According to another embodiment of the disclosure, there is provided a test method for a picture of a display panel, wherein the display panel includes pixel units defined by cross of data lines and grid lines, and for the same column of pixel units, odd numbered rows of pixel units are connected with the same data line, even numbered rows of pixel units are connected with the same data line, and the odd numbered rows of pixel units and the even numbered rows of pixel units are connected with different data lines, respectively, and the individual pixel units of the same row are connected with the same grid line, respectively, and the method includes: when a first scanning unit provides a first scanning signal to the odd numbered rows of grid lines, a data signal source providing a data signal to preset color pixel units through part of the data lines, such that the odd numbered rows of preset color pixel units of the display panel display the preset color, and when a second scanning unit provides a second scanning signal to the even numbered rows of grid lines, the data signal source providing a data signal to preset color pixel units through part of the data lines, such that the even numbered rows of preset color pixel units of the display panel display the preset color.

In an embodiment, there is a preset time interval between the first scanning signal and the second scanning signal.

In an embodiment, the first scanning unit includes first field effect tubes arranged in one-to-one correspondence with individual odd numbered rows of grid lines, and that a first scanning unit provides a first scanning signal to the odd numbered rows of grid lines includes: controlling the first field effect tubes to be turned on, and transmitting the first scanning signal to the individual odd numbered rows of grid lines via the individual first field effect tubes.

In an embodiment, the second scanning unit includes second field effect tubes arranged in one-to-one correspondence with individual even numbered rows of grid lines, and that a second scanning unit provides a second scanning signal to the even numbered rows of grid lines includes: controlling the second field effect tubes to be turned on, and transmitting the second scanning signal to the individual even numbered rows of grid lines via the individual second field effect tubes.

In an embodiment, the data line includes a first data line, a second data line and a third data line, and the first data line, the second data line and the third data line are repetitively arranged in sequence along the row direction. The data signal source includes a first data signal source, a second data signal source and a third data signal source. The data signal source further includes a first switch tube, a second switch tube and a third switch tube, wherein a first terminal of the first switch tube is connected with the first data line, and a second terminal thereof is connected with the first data signal source, a first terminal of the second switch tube is connected with the second data line, and a second terminal thereof is connected with the second data signal source, and a first terminal of the third switch tube is connected with the third data line, and a second terminal thereof is connected with the third data signal source. That when a first scanning unit provides a first scanning signal to the odd numbered rows of grid lines, a data signal source provides a data signal to preset color pixel units through part of the data lines, and when a second scanning unit provides a second scanning signal to the even numbered rows of grid lines, the data signal source provides a data signal to preset color pixel units through part of the data lines, includes: at a first color picture test phase, controlling all the switch tubes and the first field effect tubes and the second field effect tubes to be turned on, and when the first scanning unit provides the first scanning signal to the odd numbered rows of grid lines, the second data signal source providing a data signal to the second data line, and when the second scanning unit provides the second scanning signal to the even numbered rows of grid lines, the first data signal source providing a data signal to the first data line, at a second color picture test phase, controlling all the switch tubes and the first field effect tubes and the second field effect tubes to be turned on, and when the first scanning unit provides the first scanning signal to the odd numbered rows of grid lines, the third data signal source providing a data signal to the third data line, and when the second scanning unit provides the second scanning signal to the even numbered rows of grid lines, the second data signal source providing a data signal to the second data line, and at a third color picture test phase, controlling all the switch tubes and the first field effect tubes and the second field effect tubes to be turned on, and when the first scanning unit provides the first scanning signal to the odd numbered rows of grid lines, the first data signal source providing a data signal to the first data line, and when the second scanning unit provides the second scanning signal to the even numbered rows of grid lines, the third data signal source providing a data signal to the third data line.

Other features and advantages of the disclosure will be set forth in the following description, and will partially become obvious from the description, or will be learned about by implementing the invention. The objects and other advantages of the embodiments provided by the disclosure may be realized and obtained by structures specified specifically in the specification, the claims and the appended drawings.

This Summary introduces some concepts of the invention in a simplified form that are further described below in the Detailed Description. This Summary is not intended to give necessary features or essential features of the claimed subject matter, nor is it intended to limit the scope of the claimed subject matter. In addition, as described herein, various other features and advantages may also be incorporated into the techniques as needed.

BRIEF DESCRIPTION OF THE DRAWINGS

In order to more clearly illustrate the technical solutions of some embodiments of the disclosure, the disclosure provides the following appended drawings to be used in the description of the embodiments, which constitute a part of the specification and are used for explaining the technical solutions of some embodiments of the disclosure along with the embodiments of the disclosure. It should be appreciated that, the drawings in the following description only relate to some embodiments and do not constitute a limitation to the technical solutions of the invention, and for the person having ordinary skills in the art, other drawings may also be obtained according to these drawings under the premise of not paying out undue experimentation, which other drawings also fall within the scope of the invention.

DETAILED DESCRIPTION

To be able to more clearly understand the objects, technical solutions and advantages of some embodiments, in the following, the embodiments will be further described in detail in conjunction with the drawings and specific implementations. It needs to be noted that, in a case of no conflict, the embodiments of the disclosure and the features in the embodiments may be arbitrarily combined with each other.

The steps shown in a flow chart of a drawing may be performed in a computer system such as a set of computer executable instructions. Moreover, although a logic sequence is shown in the flow chart, in some cases, the shown or described steps may be performed in a different order from here.

Figure 1:
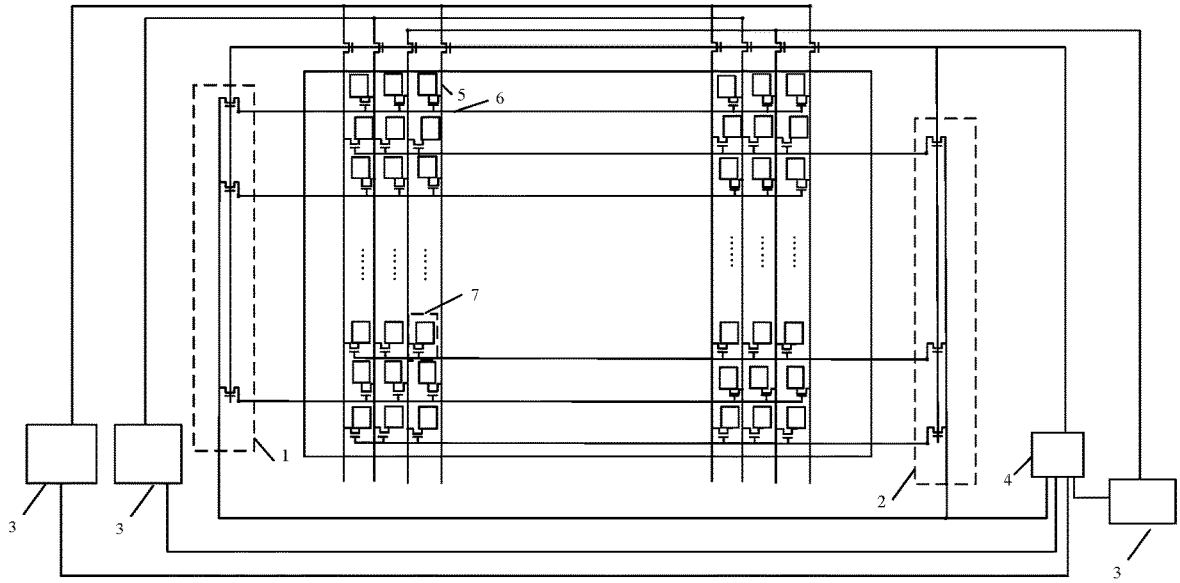
FIG. 1 is a structural block diagram of an apparatus for picture test of a display panel according to an embodiment of the disclosure.

FIG. 1 shows a structural block diagram of an apparatus for picture test of a display panel according to an embodiment of the disclosure. As shown in FIG. 1, the apparatus includes: a first scanning unit 1, a second scanning unit 2, a data signal source 3 and a controller 4. The display panel includes pixel units 7 defined by cross of data lines 5 and grid lines 6. For the same column of pixel units 7, odd numbered rows of pixel units are connected with the same data line, even numbered rows of pixel units are connected with the same data line, and the odd numbered rows of pixel units and the even numbered rows of pixel units are connected with different data lines, respectively. The individual pixel units of the same row are connected with the same grid line, respectively.

The first scanning unit 1 may be configured for receiving and transmitting a first scanning signal for scanning odd numbered rows of grid lines. The second scanning unit 2 may be configured for receiving and transmitting a second scanning signal for scanning even numbered rows of grid lines.

The data signal source 3 is connected with data lines in the display panel, and may be configured for outputting a data signal to a pixel unit in the display panel.

The controller 4 may be configured for controlling the first scanning unit 1, the second scanning unit 2 and the data signal source 3 to perform picture test on the display panel.

In an embodiment, the same column of pixel units in the display panel are pixel units that display the same color, and two adjacent columns of pixel units are pixel units that display different colors. The pixel unit includes a thin film transistor and a pixel electrode.

In an embodiment, there is a preset time interval between the first scanning signal and the second scanning signal.

In an embodiment, each of the data lines 5 may be arranged between two adjacent columns of pixel units, and connected with the odd numbered rows of pixel units of one column of the two adjacent columns of pixel units and the even numbered rows of pixel units of the other column.

Figure 2:
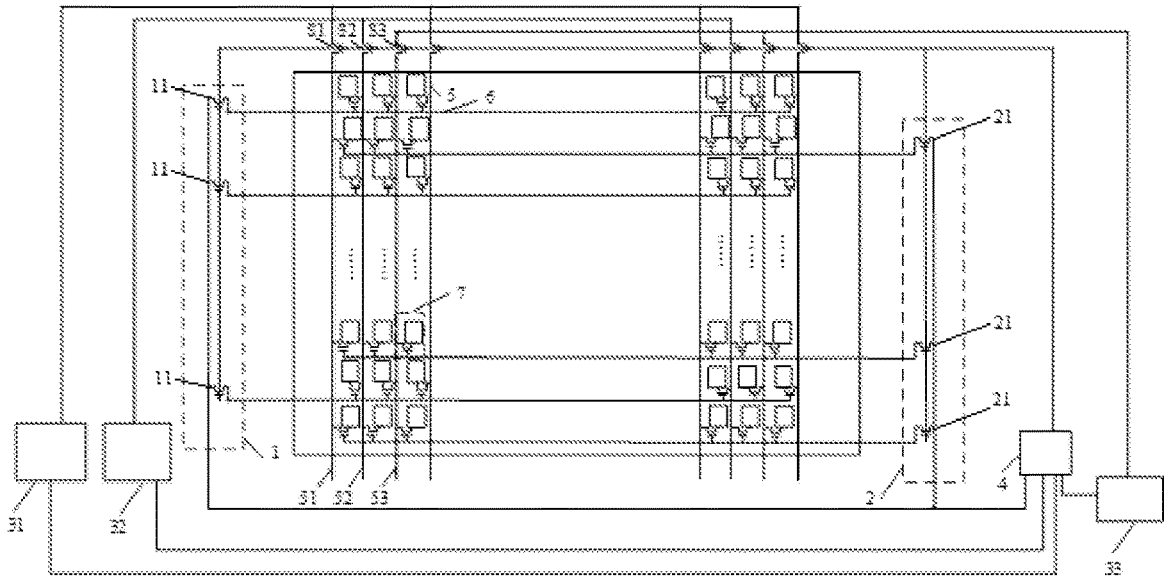
FIG. 2 is a structural block diagram of an apparatus for picture test of a display panel according to an embodiment of the disclosure.

FIG. 2 shows a structural block diagram of an apparatus for picture test of a display panel according to an embodiment of the disclosure. As shown in FIG. 2, the data line 5 may include a first data line 51, a second data line 52 and a third data line 53, and the first data line 51, the second data line 52 and the third data line 53 are repetitively arranged in sequence along the row direction. The data signal source 3 may include a first data signal source 31, a second data signal source 32 and a third data signal source 33. The data signal source 3 may further include a first switch tube S1, a second switch tube S2 and a third switch tube S3, and the control terminals of these switch tubes are connected with the controller. A first terminal of the first switch tube S1 is connected with the first data line 51, and a second terminal of the first switch tube S1 is connected with the first data signal source 31, a first terminal of the second switch tube S2 is connected with the second data line 52, and a second terminal of the second switch tube S2 is connected with the second data signal source 32, and a first terminal of the third switch tube S3 is connected with the third data line 53, and a second terminal of the third switch tube S3 is connected with the third data signal source 33.

In an embodiment, the same column of pixel units in the display panel may display the same color, and two adjacent columns of pixel units display different colors. In an embodiment, the display panel may include pixel units of three colors, and in particular, the pixel unit may include a first color pixel unit, a second color pixel unit and a third color pixel unit. For example, the first color, the second color and the third color may be three colors, red, blue and green, respectively.

In an embodiment, each of the data lines 5 may be arranged between two adjacent columns of pixel units and connected with the odd numbered rows of pixel units of one column of the two adjacent columns of pixel units and the even numbered rows of pixel units of the other column. As shown in FIG. 2, for example, the second data line 52 is arranged between the illustrated first two columns of pixel units, it is connected to the odd numbered rows of pixel units of the left column of pixel units and connected to the even numbered rows of pixel units of the right column of pixel units on the right. Likewise, the third data line 53 is connected to the odd numbered rows of pixel units of the left column of pixel units and connected to the even numbered rows of pixel units of the right column of pixel units on the right. The same is true for the first data line 51, although not clearly shown due to omitting intermediate pixel units.

In an embodiment, the first scanning unit 1 may include first field effect tubes 11 arranged in one-to-one correspondence with individual odd numbered rows of grid lines. The second scanning unit 2 may include second field effect tubes 21 arranged in one-to-one correspondence with individual even numbered rows of grid lines.

In an embodiment, both the first field effect tubes 11 and the second field effect tubes 21 are N-channel field effect tubes. Alternatively, the first field effect tubes 11 and the second field effect tubes 21 may also be P-channel field effect tubes.

There is a preset time interval between the first scanning signal and the second scanning signal, and the size of the time interval may be set by the skilled in the art according to the experience of picture test. That is to say, the second scanning unit 2 may be configured for receiving and transmitting the second scanning signal for scanning even numbered rows of grid lines after the preset time interval after the first scanning unit 1 receives and transmits the first scanning signal.

In an embodiment, the controller 4 is connected with the first scanning unit 1, the second scanning unit 2, the data signal source 3 and the pixel units 7, and the controller 4 is connected with the first data line, the second data line and the third data line through switch tubes. In particular, the controller may be configured for:

at a first color picture test phase, the controller 4 controlling all the switch tubes and the first field effect tubes 11 and the second field effect tubes 21 to be turned on, wherein when the first scanning unit 1 provides the first scanning signal to the odd numbered rows of grid lines, the second data signal source provides a data signal to the second data line 52, and when the second scanning signal scans the even numbered rows of grid lines, the first data signal source provides a data signal to the first data line 51, at a second color picture test phase, the controller 4 controlling all the switch tubes and the first field effect tubes 11 and the second field effect tubes 21 to be turned on, wherein when the first scanning unit 1 provides the first scanning signal to the odd numbered rows of grid lines, the third data signal source provides a data signal to the third data line 53, and when the second scanning signal scans the even numbered rows of grid lines, the second data signal source provides a data signal to the second data line 52, and at a third color picture test phase, the controller 4 controlling all the switch tubes and the first field effect tubes 11 and the second field effect tubes 21 to be turned on, wherein when the first scanning unit 1 provides the first scanning signal to the odd numbered rows of grid lines, the first data signal source provides a data signal to the first data line 51, and when the second scanning signal scans the even numbered rows of grid lines, the third data signal source provides a data signal to the third data line 53.

In the following, a working time sequence will be described for the apparatus provided by the above embodiments by the following example.

Taking that the field effect tube is an N-channel field effect tube as an example, the field effect tube will be switched on at a high level, and if the field effect tube is P-channeled, the field effect tube is switched on at a low level. When the first field effect tube 11 is an N-channel field effect tube, the first field effect tube 11 is turned on, the first scanning signal is transmitted to a corresponding grid line to control a pixel unit to be switched on, and meanwhile, the data signal is then inputted through a data line, and the corresponding pixel unit can display a picture. Here, the way of calculating the voltage difference is a conventional calculation mode for the skilled in the art, and what drives the deflection of a liquid crystal is the voltage difference between the voltage of a data signal received by a pixel unit and the voltage of the common electrode. Here, the voltage of the common electrode is taken as 4.9 V, and of course, it may also be taken as other voltage values. Only when the absolute value of the voltage difference between the voltage of the data signal and the common voltage is not zero, can a picture be displayed. When the voltage of the data signal is 4.5 V, the voltage difference between the two is relatively small, and it may be considered that the displayed picture is in a dark state.

Figure 3:
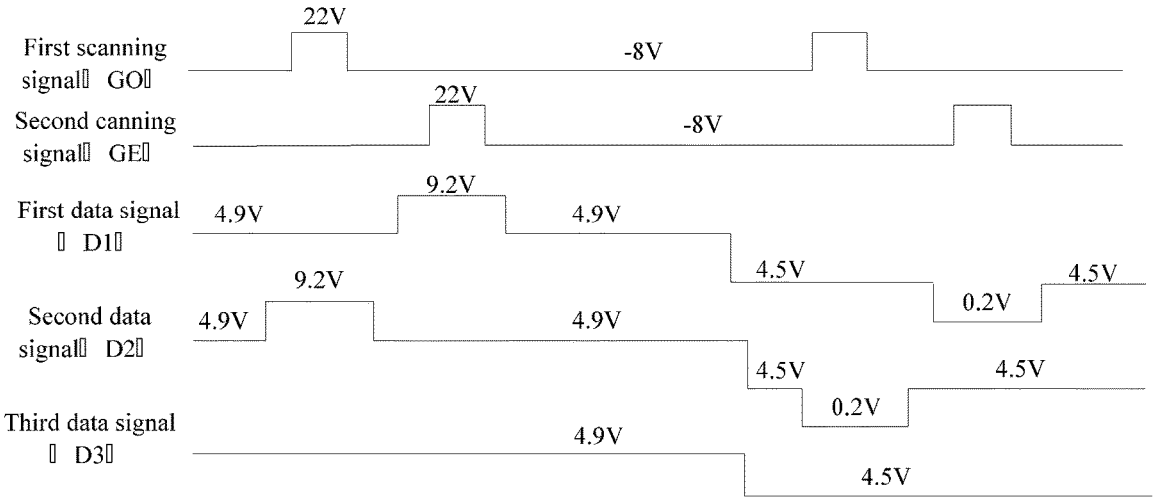
FIG. 3 is a schematic diagram of various waveforms when performing test on a red picture according to an embodiment of the disclosure.
Figure 4:
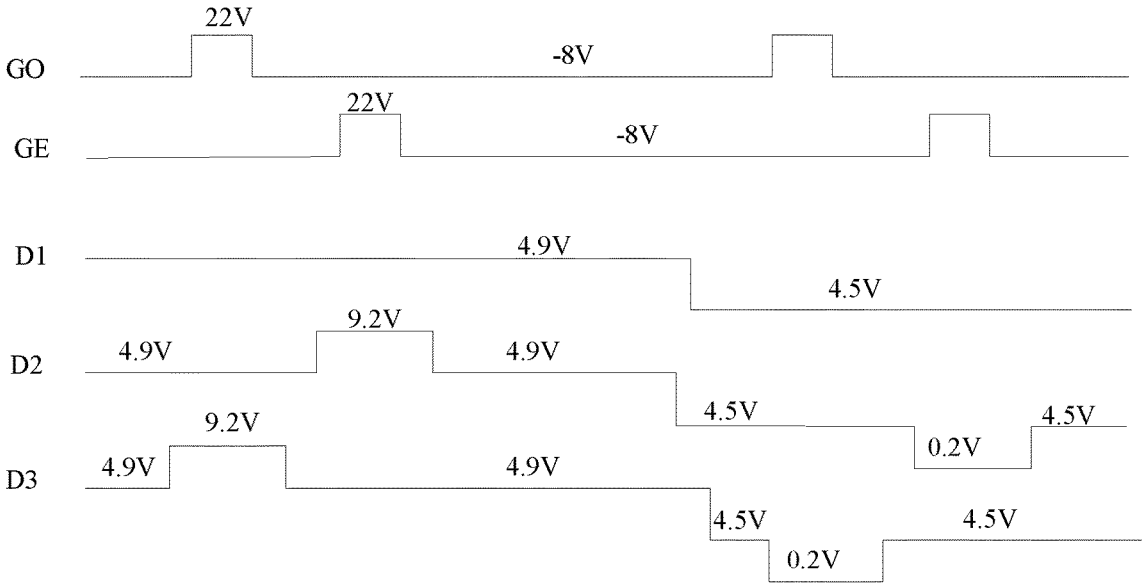
FIG. 4 is a schematic diagram of various waveforms when performing test on a blue picture according to an embodiment of the disclosure.
Figure 5:
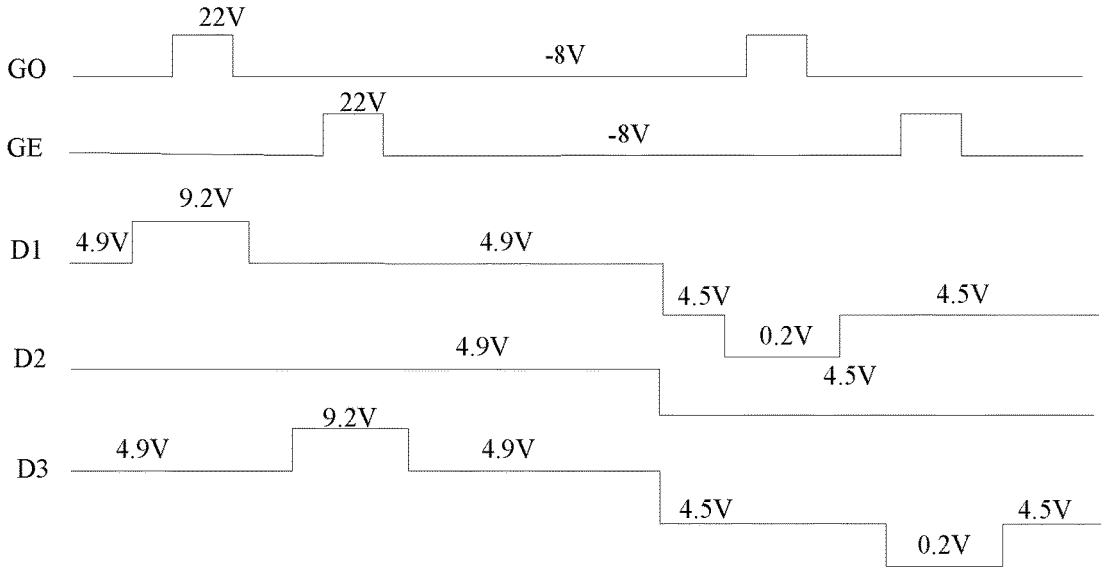
FIG. 5 is a schematic diagram of various waveforms when performing test on a green picture according to an embodiment of the disclosure.

FIGS. 3-5 show schematic diagrams of the waveforms of individual signals when performing test on red, blue and green pictures according to some embodiments of the disclosure. As shown in FIG. 3, therein, GO is the first scanning signal, GE is the second scanning signal, D1 is the first data signal, D2 is the second data signal, D3 is the third data signal. The first scanning signal and the second scanning signal provide switch signals for the picture test, and by the control of the switch signals, data signals required for the picture test may be inputted in real time, and the missed detection rate at the time of the picture test may be reduced. It needs to be noted that the values of voltages in FIG. 3 are conventional voltage values when picture test is performed on a liquid crystal display. For example, when the first scanning signal is 22 V, it controls that a pixel unit in the display panel is turned on and can receive the data voltage, and when the first scanning signal is −8 V, the corresponding pixel unit is turned off.

Suppose that the first color is red, the second color is blue, and the third color is green. According to an embodiment, in the pixel array of the display panel, the same column of pixel units may be pixel units of the same color, two adjacent columns of pixel units are pixel units of different colors, and therefore, the display panel may include pixel units of three colors, red pixel units, blue pixel units and green pixel units. The red pixel units, the blue pixel units and the green pixel units may be repetitively arranged in sequence along the row direction. That is to say, the pixel array of the display panel successively includes a column of red pixel units, a column of blue pixel units, a column of green pixel units, a column of red pixel units, a column of blue pixel units, a column of green pixel units, etc.

In the following, a case of testing picture display of a first color (i.e., red) will be described by way of example, wherein it is controlled that a pixel unit which displays the first color (red) is lighted, and other colors (blue, green) will not be lighted. As shown in FIG. 3, when the first scanning signal GO for scanning odd numbered rows of grid lines received by the first scanning unit 1 is a high level signal, namely, the 22 V high level as shown in FIG. 3, all the odd numbered rows of pixel units keep a turned-on state and can receive a data signal on data signal lines connected therewith, since the first scanning unit 1 is connected to all the odd numbered rows of pixel units. Meanwhile, the second scanning signal GE for scanning even numbered rows of grid lines received by the second scanning unit 2 is a low level signal, namely, the −8 V low level signal as shown in FIG. 3, and at this point, all the even numbered rows of pixel units keep a turned-off state and cannot receive a data signal on data signal lines connected therewith, since the second scanning unit 2 is connected to all the even numbered rows of pixel units. In addition, the data signal voltages on the first and third data lines are 4.9 V, and the voltage difference between them and the voltage of the common electrode is zero, so they cannot drive a pixel unit for display, and the data signal voltage on the second data line is 9.2 V, and the voltage difference between it and the voltage of the common electrode is high, so it may drive a connected turned-on pixel unit for display. In this example, the second data signal D2 drives the odd numbered rows of first color pixel units to be lighted, and the even numbered rows of first color pixel units and all the second color pixel units and the third color pixel units are not lighted. Subsequently, the second scanning unit 2 receives a high level signal, and the first scanning unit 1 receives a low level signal, and therefore, at this point, all the even numbered rows of pixel units keep a turned-on state and can receive a data signal on data signal lines connected therewith, and all the odd numbered rows of pixel units keep a turned-off state and cannot receive a data signal on data signal lines connected therewith. At this point, the voltage of the data signal D1 on the first data line is 9.2 V, and the voltage difference between it and the voltage of the common electrode is high, so it may drive a connected turned-on pixel unit for display. The voltages of the data signals D2, D3 on the second and third data lines are 4.9 V, and the voltage difference between them and the voltage of the common electrode is zero, so they cannot drive a pixel unit for display. In this example, the first data signal D1 drives the even numbered rows of first color pixel units to be lighted, and the odd numbered rows of first color pixel units and all the second color pixel units and the third color pixel units are not lighted.

When the first scanning signal GO becomes a high level again, the second scanning signal GE is at a low level, and therefore, all the odd numbered rows of pixel units keep a turned-on state, and all the even numbered rows of pixel units keep a turned-off state. At this point, the voltage of the data signal D2 on the second data line is 0.2 V, and the voltage difference between it and the voltage of the common electrode is high, so it can drive the odd numbered rows of first color pixel units to be lighted. However, the voltages of the data signals D1, D3 on the first and third data lines are 4.5 V, and the voltage difference between them and the voltage of the common electrode is low, so the first data signal D1 drives the odd numbered rows of third color pixel units for display, and the third data signal D3 drives the odd numbered rows of second color pixel units for display, but both are in a dark state. Subsequently, when the second scanning signal GE becomes a high level again, the first scanning signal GO is at a low level, all the even numbered rows of pixel units keep a turned-on state, and all the odd numbered rows of pixel units keep a turned-off state. At this point, the voltage of the data signal D1 on the first data line is 0.2 V, and the voltage difference between it and the voltage of the common electrode is high, so it drives the even numbered rows of first color pixel units to be lighted. However, the voltages of the data signals on the second and third data lines are 4.5 V, and the voltage difference between them and the voltage of the common electrode is low, so the second data signal drives the even numbered rows of second color pixel units for display, and the third data signal drives the even numbered rows of third color pixel units for display, but both are in a dark state.

The above is just a case of testing display of first color pixel units. It may be appreciated that the first scanning unit 1, the second scanning unit 2, the first data signal source 31, the second data signal source 32 and the third data signal source 33 are controlled to output waveforms in FIG. 4 and FIG. 5 by the controller, such that the display of a second color (i.e., blue) picture and the display of a third color (i.e., green) picture is achieved, thereby completing picture test of the display panel, which will not be repeated here any longer.

Figure 6:
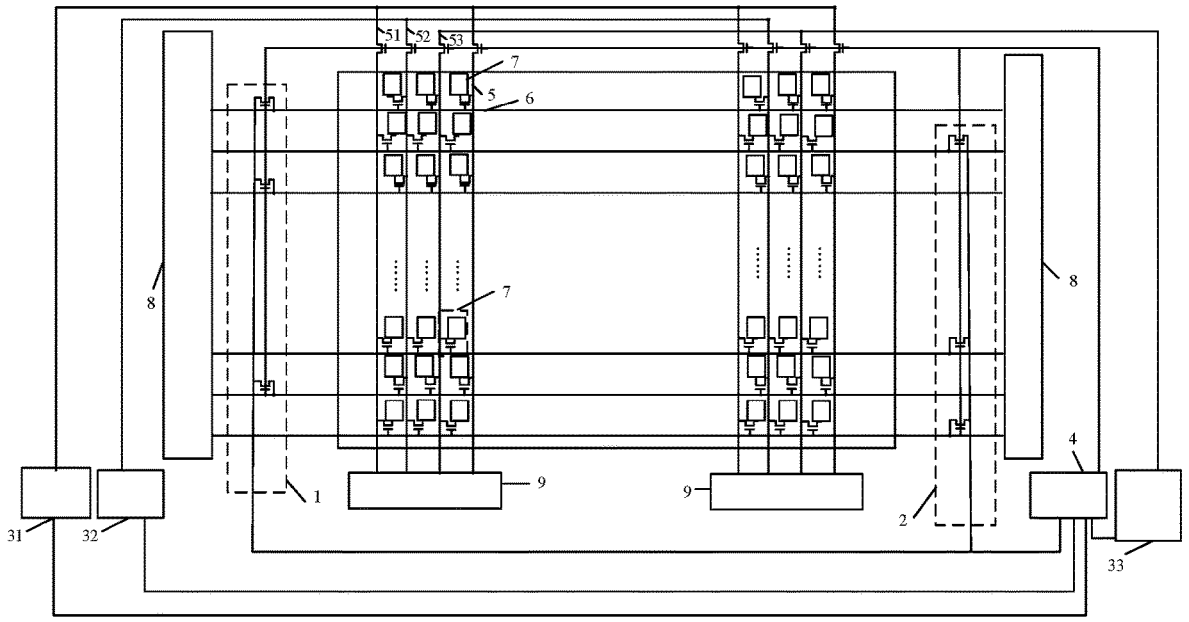
FIG. 6 is a structural block diagram of an apparatus for picture test of a display panel according to an embodiment of the disclosure.

FIG. 6 shows a structural block diagram of an apparatus for picture test of a display panel according to an embodiment of the disclosure. As shown in FIG. 6, the apparatus of the embodiment may further include a gate driver on array substrate (GOA) part. It may be appreciated that, when it is necessary to test a grayscale picture, it may be possible to directly employ a GOA 8 and a data integrated circuit 9, wherein the GOA 8 provides a scanning signal, and the data integrated circuit 9 provides a data signal to drive pixel units to display various gray levels.

As compared to the related art, the technical solutions of some embodiments of the disclosure include: a first scanning unit, a second scanning unit, a data signal source and a controller, wherein the display panel includes pixel units defined by cross of data lines and grid lines, and for the same column of pixel units, odd numbered rows of pixel units are connected with the same data line, even numbered rows of pixel units are connected with the same data line, and the odd numbered rows of pixel units and the even numbered rows of pixel units are connected with different data lines, respectively, the individual pixel units of the same row are connected with the same grid line, respectively, the first scanning unit may be configured for receiving and transmitting a first scanning signal for scanning odd numbered rows of grid lines, which first scanning signal is used for scanning odd numbered rows of grid lines in the display panel, the second scanning unit may be configured for receiving and transmitting a second scanning signal for scanning even numbered rows of grid lines, which second scanning signal is used for scanning even numbered rows of grid lines in the display panel, the data signal source is connected with data lines in the display panel, and may be configured for outputting a data signal to a pixel unit in the display panel, and the controller may be configured for controlling the first scanning unit, the second scanning unit and the data signal source to perform picture test on the display panel. The embodiments avoid that the delay affects the picture test, and realize the display test of the display panel.

Figure 7:
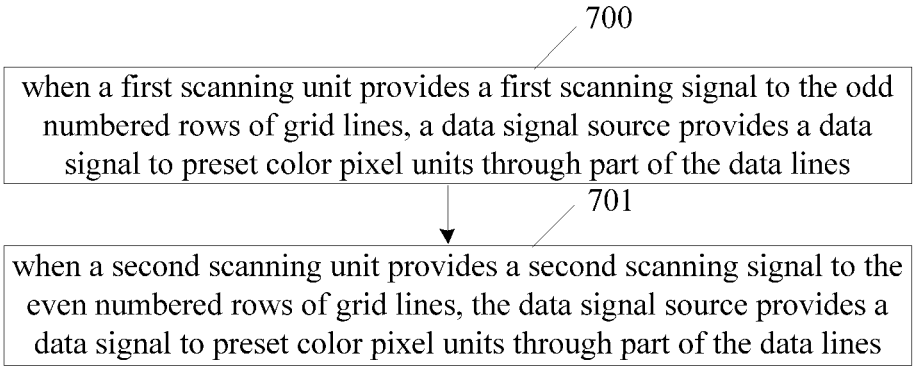
FIG. 7 is a flow chart of a test method for a picture of a display panel according to an embodiment of the disclosure.

FIG. 7 shows a flow chart of a test method for a picture of a display panel according to an embodiment of the disclosure. The display panel includes pixel units defined by cross of data lines and grid lines, and for the same column of pixel units, odd numbered rows of pixel units are connected with the same data line, even numbered rows of pixel units are connected with the same data line, and the odd numbered rows of pixel units and the even numbered rows of pixel units are connected with different data lines, respectively, and the individual pixel units of the same row are connected with the same grid line, respectively. As shown in FIG. 7, the method may include:

step 700, when a first scanning unit provides a first scanning signal to the odd numbered rows of grid lines, a data signal source providing a data signal to preset color pixel units through part of the data lines, such that the odd numbered rows of preset color pixel units of the display panel display the preset color, and step 701, when a second scanning unit provides a second scanning signal to the even numbered rows of grid lines, the data signal source providing a data signal to preset color pixel units through part of the data lines, such that the even numbered rows of preset color pixel units of the display panel display a preset color picture.

In an embodiment, there may be a preset time interval between the first scanning signal and the second scanning signal.

In an embodiment, the first scanning unit includes first field effect tubes 11 arranged in one-to-one correspondence with individual odd numbered rows of grid lines, and that a first scanning unit provides a first scanning signal to the odd numbered rows of grid lines includes:

controlling the first field effect tubes 11 to be turned on, and transmitting the first scanning signal to the individual odd numbered rows of grid lines via the individual first field effect tubes 11.

In an embodiment, the second scanning unit includes second field effect tubes 21 arranged in one-to-one correspondence with individual even numbered rows of grid lines, and that a second scanning unit provides a second scanning signal to the even numbered rows of grid lines includes:

controlling the second field effect tubes 21 to be turned on, and transmitting the second scanning signal to the individual n numbered rows of grid lines via the individual second field effect tubes 21.

In an embodiment, the data line includes a first data line, a second data line and a third data line, the first data line, the second data line and the third data line are repetitively arranged in sequence along the row direction, the data signal source includes a first data signal source, a second data signal source and a third data signal source, and the data signal source further includes a first switch tube S1, a second switch tube S2 and a third switch tube S3, wherein a first terminal of the first switch tube S1 is connected with the first data line, and a second terminal thereof is connected with the first data signal source, a first terminal of the second switch tube S2 is connected with the second data line, and a second terminal thereof is connected with the second data signal source, and a first terminal of the third switch tube S3 is connected with the third data line, and a second terminal thereof is connected with the third data signal source, that when a first scanning unit provides a first scanning signal to the odd numbered rows of grid lines, a data signal source provides a data signal to preset color pixel units through part of the data lines, and when a second scanning unit provides a second scanning signal to the even numbered rows of grid lines, the data signal source provides a data signal to preset color pixel units through part of the data lines, includes:

at a first color picture test phase, controlling all the switch tubes and the first field effect tubes 11 and the second field effect tubes 21 to be turned on, and when the first scanning unit provides the first scanning signal to the odd numbered rows of grid lines, the second data signal source providing a data signal to the second data line, and when the second scanning signal scans the even numbered rows of grid lines, the first data signal source providing a data signal to the first data line, at a second color picture test phase, controlling all the switch tubes and the first field effect tubes 11 and the second field effect tubes 21 to be turned on, and when the first scanning unit provides the first scanning signal to the odd numbered rows of grid lines, the third data signal source providing a data signal to the third data line, and when the second scanning signal scans the even numbered rows of grid lines, the second data signal source providing a data signal to the second data line, and at a third color picture test phase, controlling all the switch tubes and the first field effect tubes 11 and the second field effect tubes 21 to be turned on, and when the first scanning unit provides the first scanning signal to the odd numbered rows of grid lines, the first data signal source providing a data signal to the first data line, and when the second scanning signal scans the even numbered rows of grid lines, the third data signal source providing a data signal to the third data line.

It may be appreciated by the person having ordinary skills in the art that, all or part of the steps in the above methods may be completed by related hardware (e.g., a processor) being instructed by a program, which program may be stored in a computer readable storage medium, for example, a read-only memory, a magnetic disk or a compact disc, etc. All or part of the steps of the above embodiments may also be implemented using one or more integrated circuit. Accordingly, each module/unit in the above embodiments may be implemented in the form of hardware, for example, its corresponding function is realized by an integrated circuit, or also be implemented in the form of a software functional module, for example, its corresponding function is realized by a processor executing a program/instructions stored in a memory. The invention is not restricted to a combination of hardware and software in any specific form.

It may be appreciated that, what are described above are just exemplary embodiments of the invention, however, the protective scope of the invention is not limited thereto. It should be pointed out that, various variations or alternatives may readily occur to the person having ordinary skills in the art, and these variations or alternatives should all be encompassed in the protective scope of the invention, without departing from the spirit and principle of the invention. Therefore, the protective scope of the invention should be subject to the protective scope of the appended claims.

It needs to be noted that, the above embodiments are just illustrated by division of the above various functional modules, and in a practical application, the above functions may be allocated to different functional modules for accomplishment as needed. It may be possible to divide the internal structure of the apparatus into different functional modules to accomplish all or part of the above described functions. In addition, the function of one module described above may be accomplished by multiple modules, and the functions of multiple modules described above may also be integrated into one module for accomplishment.

In this application, wordings such as "first", "second", and "third", etc. are used. When there is no additional context, use of such wordings does not aim at implying ordering, and in fact, they are just used for the purpose of identification. For example, the phrases "first data line" and "second data line" do not necessarily mean that the first data line is located above the second data line in terms of position, or also do not mean that the first data line is driven and controlled before the second data line in terms of time. In fact, the phrases are just used to identify different data lines.

In the claims, any reference sign placed between the parentheses shall not be construed as limiting to a claim. The term "include" does not exclude the presence of an element or a step other than those listed in a claim. The word "a" or "an" preceding an element does not exclude the presence of a plurality of such elements. The invention may be implemented by means of a hardware including several distinct elements, or by means of suitably programmed software or firmware, or by any combination thereof.

In a device or system claim enumerating several apparatuses, one or more of the apparatuses may be embodied by one and the same hardware item. The mere fact that certain measures are recited in mutually different dependent claims does not indicate that a combination of these measures cannot be used to advantage.

The invention claimed is:

1. An apparatus for picture test of a display panel, including a first scanning unit, a second scanning unit, a data signal source and a controller, wherein the display panel includes pixel units defined by cross of data lines and grid lines, and for the same column of pixel units, odd numbered rows of pixel units are connected with the same data line, even numbered rows of pixel units are connected with the same data line, and the odd numbered rows of pixel units and the even numbered rows of pixel units are connected with different data lines, respectively, the individual pixel units of the same row are connected with the same grid line, respectively, the first scanning unit is configured for receiving and transmitting a first scanning signal for scanning odd numbered rows of grid lines, the second scanning unit is configured for receiving and transmitting a second scanning signal for scanning even numbered rows of grid lines, the data signal source is connected with data lines in the display panel, and configured for outputting a data signal to a pixel unit in the display panel, wherein the first scanning unit includes first field effect tubes arranged in one-to-one correspondence with individual odd numbered rows of grid lines, and that a first scanning unit provides a first scanning signal to the odd numbered rows of grid lines includes: controlling the first field effect tubes to be turned on and transmitting the first scanning signal to the individual odd numbered rows of grid lines via the individual first field effect tubes, wherein the second scanning unit includes second field effect tubes arranged in one-to-one correspondence with individual even numbered rows of grid lines, and that a second scanning unit provides a second scanning signal to the even numbered rows of grid lines includes: controlling the second field effect tubes to be turned on and transmitting the second scanning signal to the individual even numbered rows of grid lines via the individual second field effect tubes, wherein the data line includes a first data line, a second data line and a third data line, and the first data line, the second data line and the third data line are repetitively arranged in sequence along a row direction, the data signal source includes a first data signal source, a second data signal source and a third data signal source, the data signal source further includes a first switch tube, a second switch tube and a third switch tube, wherein a first terminal of the first switch tube is connected with the first data line, and a second terminal thereof is connected with the first data signal source, a first terminal of the second switch tube is connected with the second data line, and a second terminal thereof is connected with the second data signal source, and a first terminal of the third switch tube is connected with the third data line, and a second terminal thereof is connected with the third data signal source, wherein the controller is configured for controlling the first scanning unit, the second scanning unit and the data signal source to perform preset color picture test on the display panel, including:

at a first color picture test phase, controlling all the switch tubes and the first field effect tubes and the second field effect tubes to be turned on, and when the first scanning unit provides the first scanning signal to the odd numbered rows of grid lines, the second data signal source providing a data signal to the second data line, and when the second scanning unit provides the second scanning signal to the even numbered rows of grid lines, the first data signal source providing a data signal to the first data line, at a second color picture test phase, controlling all the switch tubes and the first field effect tubes and the second field effect tubes to be turned on, and when the first scanning unit provides the first scanning signal to the odd numbered rows of grid lines, the third data signal source providing a data signal to the third data line, and when the second scanning unit provides the second scanning signal to the even numbered rows of grid lines, the second data signal source providing a data signal to the second data line, and at a third color picture test phase, controlling all the switch tubes and the first field effect tubes and the second field effect tubes to be turned on, and when the first scanning unit provides the first scanning signal to the odd numbered rows of grid lines, the first data signal source providing a data signal to the first data line, and when the second scanning unit provides the second scanning signal to the even numbered rows of grid lines, the third data signal source providing a data signal to the third data line.

2. The apparatus as claimed in claim 1, wherein there is a preset time interval between the first scanning signal and the second scanning signal.

3. The apparatus as claimed in claim 2, wherein the same column of pixel units in the display panel display the same color, and two adjacent columns of pixel units display different colors.

4. The apparatus as claimed in claim 3, wherein each of the data lines is arranged between two adjacent columns of pixel units, and connected with an odd numbered rows of pixel units of one column of the two adjacent columns of pixel units and the even numbered rows of pixel units of the other column.

5. The apparatus as claimed in claim 1, wherein both the first field effect tubes and the second field effect tubes are N-channel field effect tubes.

6. A test method for a picture of a display panel, the display panel including pixel units defined by cross of data lines and grid lines, and for the same column of pixel units, odd numbered rows of pixel units being connected with the same data line, even numbered rows of pixel units being connected with the same data line, and the odd numbered rows of pixel units and the even numbered rows of pixel units being connected with different data lines, respectively, and the individual pixel units of the same row being connected with the same grid line, respectively, and the method including:

when a first scanning unit provides a first scanning signal to an odd numbered rows of grid lines, a data signal source providing a data signal to preset color pixel units through part of the data lines, such that the odd numbered rows of preset color pixel units of the display panel display the preset color, and when a second scanning unit provides a second scanning signal to the even numbered rows of grid lines, the data signal source providing a data signal to preset color pixel units through part of the data lines, such that the even numbered rows of preset color pixel units of the display panel display the preset color, wherein the first scanning unit includes first field effect tubes arranged in one-to-one correspondence with individual odd numbered rows of grid lines, and that a first scanning unit provides a first scanning signal to the odd numbered rows of grid lines includes: controlling the first field effect tubes to be turned on and transmitting the first scanning signal to the individual odd numbered rows of grid lines via the individual first field effect tubes, wherein the second scanning unit includes second field effect tubes arranged in one-to-one correspondence with individual even numbered rows of grid lines, and that a second scanning unit provides a second scanning signal to the even numbered rows of grid lines includes: controlling the second field effect tubes to be turned on and transmitting the second scanning signal to the individual even numbered rows of grid lines via the individual second field effect tubes, wherein the data line includes a first data line, a second data line and a third data line, and the first data line, the second data line and the third data line are repetitively arranged in sequence along a row direction, the data signal source includes a first data signal source, a second data signal source and a third data signal source, the data signal source further includes a first switch tube, a second switch tube and a third switch tube, wherein a first terminal of the first switch tube is connected with the first data line, and a second terminal thereof is connected with the first data signal source, a first terminal of the second switch tube is connected with the second data line, and a second terminal thereof is connected with the second data signal source, and a first terminal of the third switch tube is connected with the third data line, and a second terminal thereof is connected with the third data signal source, that when a first scanning unit provides a first scanning signal to the odd numbered rows of grid lines, a data signal source provides a data signal to preset color pixel units through part of the data lines, and when a second scanning unit provides a second scanning signal to the even numbered rows of grid lines, the data signal source provides a data signal to preset color pixel units through part of the data lines, includes:

at a first color picture test phase, controlling all the switch tubes and the first field effect tubes and the second field effect tubes to be turned on, and when the first scanning unit provides the first scanning signal to the odd numbered rows of grid lines, the second data signal source providing a data signal to the second data line, and when the second scanning unit provides the second scanning signal to the even numbered rows of grid lines, the first data signal source providing a data signal to the first data line, at a second color picture test phase, controlling all the switch tubes and the first field effect tubes and the second field effect tubes to be turned on, and when the first scanning unit provides the first scanning signal to the odd numbered rows of grid lines, the third data signal source providing a data signal to the third data line, and when the second scanning unit provides the second scanning signal to the even numbered rows of grid lines, the second data signal source providing a data signal to the second data line, and at a third color picture test phase, controlling all the switch tubes and the first field effect tubes and the second field effect tubes to be turned on, and when the first scanning unit provides the first scanning signal to the odd numbered rows of grid lines, the first data signal source providing a data signal to the first data line, and when the second scanning unit provides the second scanning signal to the even numbered rows of grid lines, the third data signal source providing a data signal to the third data line.

7. The test method as claimed in claim 6, wherein there is a preset time interval between the first scanning signal and the second scanning signal.

8. The test method as claimed in claim 7, wherein the first scanning unit includes first field effect tubes arranged in one-to-one correspondence with individual odd numbered rows of grid lines, and that a first scanning unit provides a first scanning signal to the odd numbered rows of grid lines includes:

controlling the first field effect tubes to be turned on and transmitting the first scanning signal to the individual odd numbered rows of grid lines via the individual first field effect tubes.

* * * * *